United States Patent [19]

Jenkin

[11] 4,076,136

[45] Feb. 28, 1978

[54] PIPE STRAIGHTENING AND SPINNING METHOD AND APPARATUS

[75] Inventor: Royston Paul Jenkin, St. Austell, England

[73] Assignee: English Clays Lovering Pochin & Co. Ltd., St. Austell, England

[21] Appl. No.: 631,233

[22] Filed: Nov. 12, 1975

[30] Foreign Application Priority Data

Nov. 21, 1974 United Kingdom ..... 50585/74
Nov. 21, 1974 United Kingdom ..... 50587/74

[51] Int. Cl.[2] ..... B21D 3/02

[52] U.S. Cl. ..... 214/340; 72/110; 214/1 P; 427/231

[58] Field of Search ..... 72/110, 46; 214/1 P, 214/340; 427/183, 231, 234; 53/211; 118/55, 53, 44; 164/291, 292, 298, 114, 115; 425/435

[56] References Cited

U.S. PATENT DOCUMENTS

| | | | |
|---|---|---|---|
| 1,418,659 | 6/1922 | Lantery | 53/211 |
| 1,548,731 | 8/1925 | Mirfield | 72/110 |
| 2,161,968 | 6/1939 | Lyons et al. | 118/55 X |
| 2,671,260 | 3/1954 | Jessen et al. | 164/298 X |
| 2,724,421 | 11/1955 | Brannen | 72/110 |
| 2,901,793 | 9/1959 | Kurtz | 164/298 X |
| 3,098,764 | 7/1963 | Kao et al. | 118/55 |
| 3,113,608 | 12/1963 | Puyear | 72/110 |
| 3,583,191 | 6/1971 | Colonius et al. | 72/110 |
| 3,854,520 | 12/1974 | Yokota | 164/298 X |
| 3,946,799 | 3/1976 | Fort et al. | 164/292 X |

*Primary Examiner*—Travis S. McGehee
*Assistant Examiner*—Horace M. Culver
*Attorney, Agent, or Firm*—Larson, Taylor and Hinds

[57] ABSTRACT

A method and apparatus for temporarily straightening and spinning of pipes wherein at least three sets of rollers are used, each set including four rollers of which two are rotatably mounted in fixed locations and the other two of which are movable by hydraulic driving means, one or more of the fixed location rollers being drivable; collars, each made of three hinged segments, are used around the pipe, which collars are circumferentially stronger than the pipe wall; by pressing the movable rollers against the collars, the collars are held closed and the pipe is held straight while being spun. The invention is particularly although not exclusively applicable for use in a process of lining of pipes.

18 Claims, 6 Drawing Figures

PIPE STRAIGHTENING AND SPINNING METHOD AND APPARATUS

Figure 1:
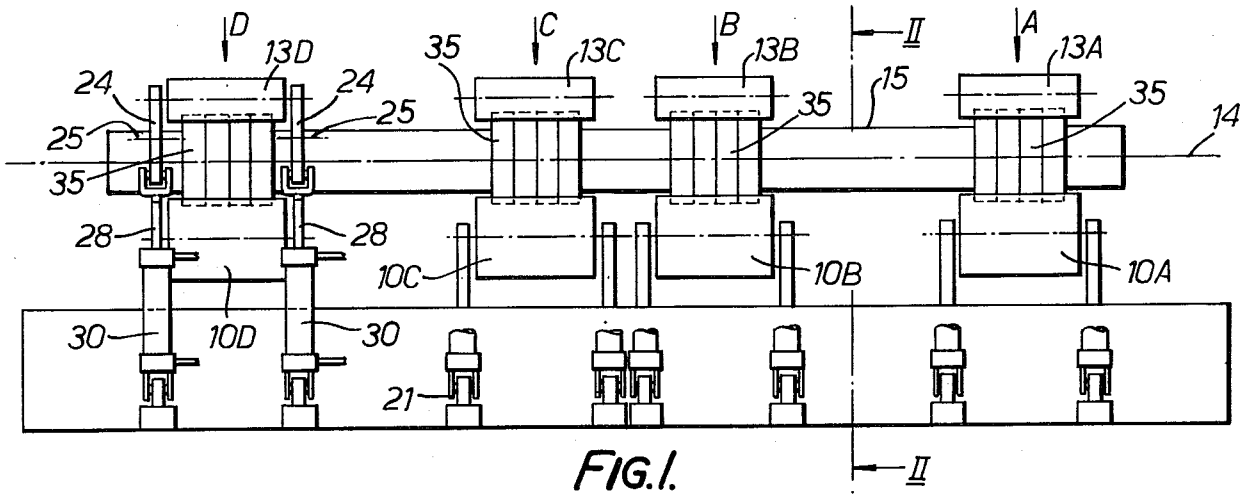

This invention relates to a method and apparatus for temporarily straightening and spinning of pipes and is particularly, although not exclusively, applicable to a method and apparatus for straightening pipes whilst they are spun as part of a lining process to distribute centrifugally the lining material and maintain rotation until it sets to form a permanent lining.

In many applications, particularly in the mining industry, it is desirable to use pipes which are provided with a lining inside; for example for transporting highly abrasive slurries, excessive wear can be reduced by lining steel pipes with a suitable polyurethane. Various proposals have been made for lining pipes, and in general the proposed methods include distributing the lining material, in liquid form, along the inside of the pipe and then spinning the pipe to cause the lining material to be spread evenly around the inside of the pipe by centrifugal force. In this way it has been proposed to line pipes with concrete, bitumen, metal and synthetic plastics materials.

Often the dimensions of the lining of the pipe are important, i.e., the radial thickness of the lining and the inside diameter. For the spinning operation difficulties arise with pipes which are not exactly straight, for two reasons: first, the high spinning speeds usually employed caused a bowed pipe to become even more bowed during spinning resulting in excessive vibrations to the machine and a resultant lining which at the mid part of the pipe length is thin at one side of the pipe and thick at the other; and secondly, even if such vibrations can be tolerated by the spinning apparatus, in order to form an acceptable minimum thickness of lining, extra lining material has to be used, and since lining materials are often rather expensive, it becomes uneconomic to attempt to line bowed pipes. To illustrate the magnitude of the problem, it can be shown that for a pipe which is bowed by $\frac{1}{4}$ in. at its mid part relative to its ends and in which a lining of $\frac{1}{8}$ in. minimum radial thickness is required, twice as much lining material has to be used than if the pipe is straight. Bearing in mind that pipes to be lined may be 20 ft. or even up to 40 ft. in length and up to 30 in. in diameter it will be appreciated that the cost of the pipes and of the lining material is such that, on the one hand it is wasteful and uneconomic to reject those pipes which are bowed, and, on the other hand it is too costly to use so much additional lining material to overcome the effect of the bow in the pipes. Moreover, the initial cost of making pipes becomes extremely high if they have to be made to very strict specifications as regards their straightness.

Permanent straightening of bowed pipe would involve complex measurements and calculations for each pipe and moreover each bowed pipe would have to be deformed beyond its elastic limit in order to straighten it permanently. Furthermore, in practice it is very often not a serious disadvantage to have a slight bow in a pipe in use, and thus the present invention relates to a method and apparatus for temporarily holding a pipe straight whilst it is spun.

The actual forces required to be applied to the pipe to straighten it depend on the length, diameter, wall thickness and material of the pipe, and the amount of eccentricity or bow to be corrected. In general it is thought that for steel pipes up to 30 in. in diameter and having a wall thickness of one-half in., the stresses produced in the pipe by the straightening forces to correct an eccentricity of 0.24 in. in a 20 ft. length are not excessive if the pipe is considered only as a simple beam. However, even using four rollers in each set and four sets of rollers, calculations of the hoop stresses set up in the pipe wall show that with large pipes, i.e., 10 in. outside diameter or larger, the difficulty may arise that the forces required to straighten the pipe approach or exceed the allowable bending stress limits of the material in the circumferential direction (so-called hoop stress).

For a given pipe length, wall thickness and material, the bending stiffness in the longitudinal direction increases with increasing diameter so that proportionately larger straightening forces are required for larger diameter pipes. With the larger forces, therefore, there is a risk that the hoop stress limit will be exceeded and the pipe will be distorted or damaged by the straightening forces or even collapse completely.

Furthermore, the effect of spinning the pipe while under the action of the straightening forces may also give rise to difficulty because each time a point on the circumference of the pipe passes one of the rollers a reversal of the stress takes place and with, say, four rollers in each set equally spaced around the circumference of the pipe, it will be appreciated that the cycles of stress may be significant where high rotational speeds are maintained for some time; for example at a spinning speed of 200 r.p.m. for 30 mins. there would be 24,000 cycles of stress, with four rollers in each set.

The present invention is also concerned, therefore, with the straightening and spinning of pipes in such a way that the pipe is not damaged by the action of the straightening forces.

According to one aspect of the present invention there is provided pipe straightening and spinning apparatus comprising at least three sets of rollers, the axes of all the rollers being parallel and each set comprising four rollers arranged for acting at approximately equally spaced circumferential positions relative to a pipe located between them, the sets of rollers being spaced from each other in the axial direction so as to act at predetermined positions along the pipe length, two rollers of each set being rotatably mounted in bearings fixed to a rigid frame and the other two rollers of each set being rotatably mounted and reciprocably movable in directions perpendicular to the axes of the said other two rollers and generally toward or away from the axis of a pipe when located between the rollers, there being provided a plurality of collars, one for each set of rollers, to be positioned around a pipe at axial spacings along the pipe corresponding to the axial positions of the roller sets and which collars are adapted to closely surround the pipe and to have a higher yield strength in the circumferential direction than that of the pipe wall, each collar being formed of three segments of approximately equal arcuate length and two of the segments being hingedly connected to respective opposite ends of the third segment so as to allow the segments to be pivoted relative to each other to open the collar for positioning the collar around the pipe, hydraulic driving means for moving each movable roller of each set into contact with the respective collars to hold the collars in a closed condition around the pipe by roller contact and for applying pressure against the respective collars thereby to hold the pipe temporarily straight, and means for drivingly rotating one or more of the fixed position rollers for spinning the pipe.

Preferably the said movable rollers are movably mounted by means of, for example, hydraulic jacks, the jacks in use being connected to a high-pressure source; in this way a substantially constant pressure can be applied to the pipe being straightened by the movable rollers. Advantageously four sets of rollers are provided which are arranged, for a given pipe length, so that two of the sets are axially located respectively adjacent each end of the pipe and two of the sets are axially near the midportion of the pipe.

Conveniently for straightening and spinning steel pipes, all the rollers are also made of steel and preferably, but not essentially, all the fixed-position rollers are driven.

According to a further aspect of the present invention there is provided a method of straightening and spinning a nonstraight pipe comprising providing a plurality of removable circular collars axially spaced along the pipe, which collars circumferentially closely surround the pipe and have a higher yield strength in the circumferential direction than that of the pipe wall, each collar being formed of three segments of approximately equal arcuate length and two of the segments being hingedly connected to respective opposite ends of the third segment so as to allow the segments to be pivoted relative to each other to open the collar for positioning the collar around the pipe, applying forces to the collars by means of roller elements in directions so as to straighten the pipe and to hold it substantially straight during rotation, and rotating the collars and the pipe.

The three segment collars are opened and then they can be placed around the pipe, (or the pipe can be located in the open collars), and then each collar can be closed, by swinging the two hinged segments to a closed position in which the free edges of the two hinged segments abut each other so that the segments form a complete annulus, to hold it in the position on the pipe. Split collars are essential if the pipe has end flanges.

One collar may be provided for each set of rollers so that the rollers of each set bear directly against a collar; with the three-segmented collars at least one of the four rollers of each set presses against a segment of the collar in all rotary positions of the collar. It may also be possible to arrange for one collar to span two sets of rollers.

Figure 1B:
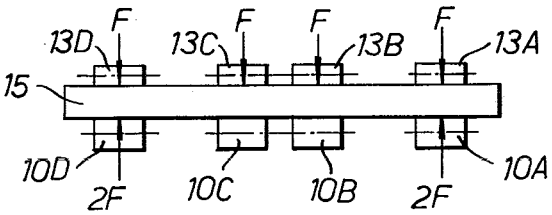
Figure 1A:
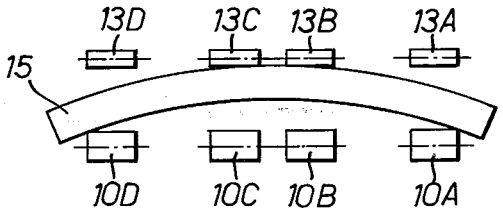
Figure 2:
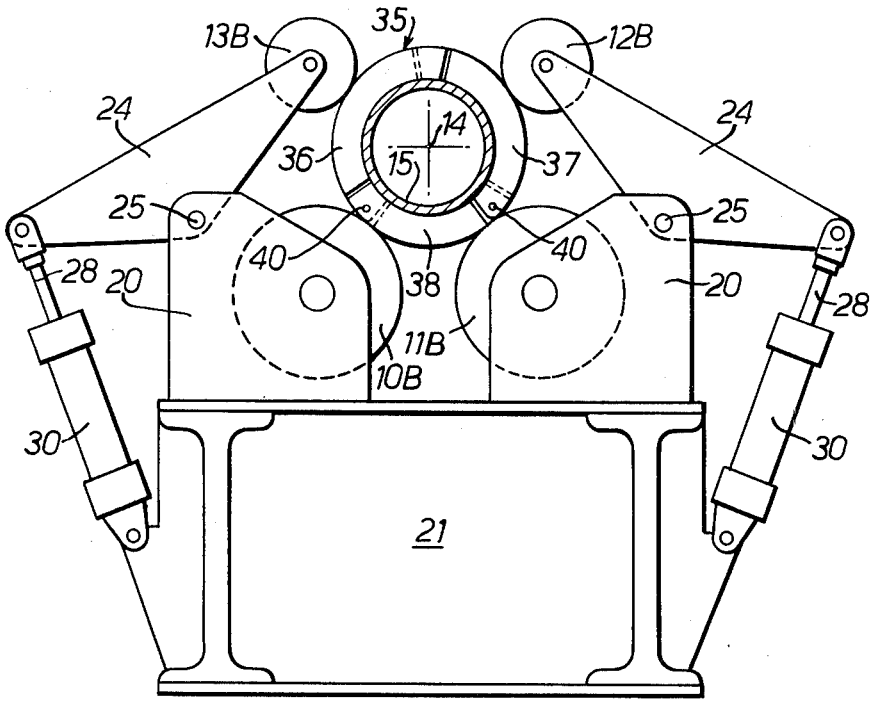
Figure 3:
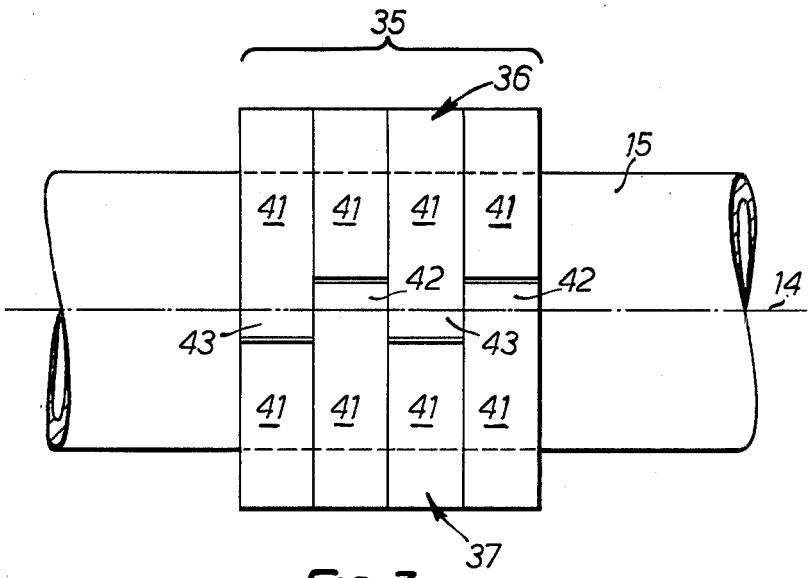
Figure 4:
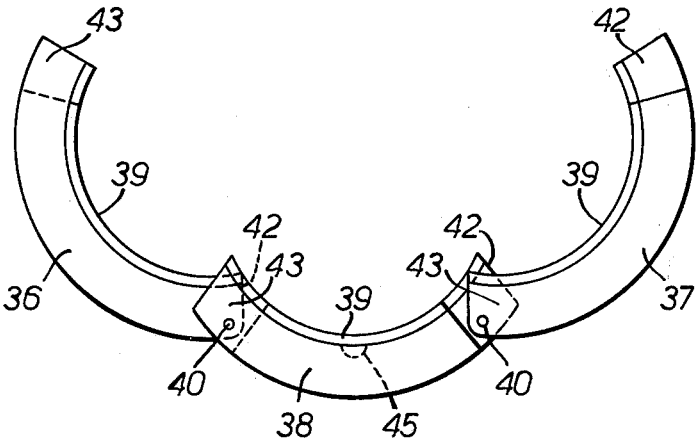

The invention may be carried into practice in a number of ways but one specific embodiment will now be described, by way of example only, with reference to the accompanying drawings, in which:

FIG. 1 is a diagrammatic side view of pipe straightening and spinning apparatus in accordance with the invention, FIGS. 1A and 1B are diagrams illustrating the operation of the apparatus of FIG. 1, FIG. 2 is a view taken on the line II — II of FIG. 1, FIG. 3 is a view from above one of the collars shown in FIG. 1, and FIG. 4 is a view taken in the axial direction of the collar of FIG. 3, when opened ready to receive a pipe.

The apparatus shown in the drawings is particularly applicable for use in a pipe lining operation wherein pipes are lined with polyurethane material. The apparatus shown in FIGS. 1 and 2 comprises generally four sets of rollers A, B, C, D, the axes of all the rollers being parallel and each set including two fixed-position rollers 10 and 11, and two movable rollers 12 and 13, the rotary axes of the rollers which correspond in position in each set being axially aligned. The axial length of each roller is equal to at least the diameter of the pipe and is preferably greater than twice the diameter of the pipe. As is shown in FIG. 2 the four rollers 10 - 13 of each set are approximately equally spaced circumferentially about the centre-line 14 of a pipe 15 which is to be held straight whilst being spun.

The two fixed-position rollers 10 and 11 of each set are supported by bearing brackets 20 which are mounted on a rigid strongback 21 which is sufficiently rigid to act as a brace for withstanding the large forces involved in straightening the pipe 15 by means of pressure applied via the movable rollers 12 and 13. Thus, the stiffness of the strongback must be many times greater than the stiffness of the pipe to be straightened. The strongback 21 forms a base, which may for example be embedded in a concrete floor and the fixed-position rollers 10 and 11 are attached to the top surface of the strongback 21 with their axes lying in a common horizontal plane.

The axes of the two movable rollers 12 and 13 of each set also lie in a common horizontal plane. The movable rollers 12 and 13 are each carried by the ends of two rocking levers 24 which are pivotably mounted intermediate the ends thereof about pivots 25 supported by the bearing brackets 20. To the other end of each lever 24 is pivotably connected the piston rod 28 of a hydraulic jack 30, the cylinder of which is pivotably connected to the side of the strongback 21. Thus, by operating the jacks 30 to pivot the rocking levers 24, the movable rollers 12 and 13 are moved in unison in a direction perpendicular to their rotary axes towards or away from the center-line 14 of the pipe 15.

All the jacks 30 are connected to a common source of hydraulic pressure by a pressure line (not shown) which includes an accumulator the purpose of which is to absorb fluctuations in the positions of the rollers 12 and 13 whilst maintaining a constant force applied to the pipe 15, as will be explained.

As will be seen from FIG. 2 the movable rollers 12 and 13 are half the diameter of the fixed-position rollers 10 and 11. This is because the fixed-position rollers 10 and 11 have to withstand double the force exerted by the movable rollers 12 and 13. If, for example one considers a pipe 15 bowed upwards, in the relaxed condition, towards rollers 13B and 13C as shown, greatly exaggerated, in FIG. 1A, the pipe will initially contact only rollers 10A and 10D and will not contact rollers 10B or 10C; when the hydraulic jacks are operated to apply an appropriate pressure to all the rollers 13A to 13D the rollers 13C and 13B bear against the mid portion of the bowed pipe and make its axis straight so that the fixed-position rollers 10B and 10C will just be contacted, as shown in FIG. 1B; rollers 10A and 10D will each carry a force exerted by the ends of the pipe equal to the force F exerted by the rollers 13B and 13C and in addition the directly opposed force F exerted by the respective rollers 13A and 13D. Thus, in this position rollers 10A and 10D will each be withstanding a force 2F, i.e. double the force F exerted by each of the rollers 13A to 13D; rollers 10B and 10C will be under no load. However, if one now considers the situation when the pipe 15 is rotated through 180° it will be appreciated that the rollers 10B and 10C will then be carrying double the load exerted by each of the rollers 13A to 13D whereas rollers 10A and 10D will be under no load but will be simply in contact with the pipe 15. (It will be understood that this is a simplified explanation for rollers 10 and 13, and in practice the same distribution of forces applies for rollers 11 and 12).

All the rollers 10, 11, 12 and 13 are made of steel and all the fixed-position rollers 10 and 11 are connected to a rotary drive. In setting up the apparatus the surfaces of the rollers are all accurately aligned in the longitudinal direction.

For large diameter pipes, the straightening forces may be such as to damage the pipe if the pressure rollers are applied directly against the pipe wall. Thus, collars are used.

A plurality of collars 35, preferably one collar for each set of rollers A to D, are provided closely surrounding the pipe, each collar having a greater yield strength in the circumferential direction than that of the wall of the pipe 15.

As shown particularly in FIGS. 2 and 4, each collar 35 comprises three part-annular segments 36, 37 and 38 of approximately equal arcuate length, the segments 36 and 37 each being hingedly connected by hinge pins 40 to the segment 38 so that the three segments can be opened, as shown in FIG. 4, or closed to form a complete annular collar as shown in FIG. 2. As shown in FIG. 3, each segment consists of a number (for example four) of elements 41 arranged axially side-by-side and secured to each other, adjacent elements being in relatively staggered positions in the circumferential direction so that the ends 42 of axially alternate elements of one segment, in the closed position of the collar, lie between the ends 43 of alternate elements of an adjacent segment.

The collars 35 each have an axial extent equal to at least half the outside diameter of the pipe 15, and are positioned around the outside of the pipe 15 at appropriate axial positions so that the rollers 10 – 13 can bear against the outside of the collars. Since each collar comprises three segments it is clear that during rotation each segment must always be in contact with at least one roller in all rotary positions of the collar so that it is not necessary to provide any connecting means between the free ends 42 and 43 of the two segments 36 and 37. Moreover, by virtue of the "meshing" arrangement of the ends 42 and 43 of the elements of any two segments, as the collar rotates there is not a sudden transfer of pressure from one collar segment to another.

The inside diameter of the closed collars 35 is such that they form a close fit around the outside of the pipe. Each collar 35 may be provided with a groove 45, shown in dotted lines in FIG. 5, to accommodate the weld rib of a spirally welded pipe.

When the hydraulic pressure is increased to force the movable rollers 12 and 13 against the collars 35, the collars will distribute the stress around the wall of the pipe 15 and thereby avoid local high stresses in the pipe wall and preclude any possibility of damage or distortion to the pipe. The pressure exerted by the rollers 12 and 13 against the collars 35 will cause each collar to be urged centrally between the rollers 10 to 13 thus causing the pipe 15 to adopt a straight or more nearly straight form. The collars 35 are rotated by the rotary drive to the fixed rollers 10 and 11 and thus the pipe can be spun, for example to distribute the lining material.

In operation, the steel pipe to be lined is prepared and liquid polyurethane mixture is introduced for example by inclining the pipe and allowing the mixture to flow down its length and shifting the pipe to a horizontal position. By operating the jacks 30 the movable rollers 12 and 13 are swung upwards and away from the rollers 10 to allow the pipe 15 having the liquid polyurethane distributed along its length to be positioned in the open collars 35 resting on the rollers 10, 11 and the jacks 30 are then operated to bring the rollers 12 and 13 into contact with the collars. The drive to the rollers 10 and 11 is then started and by contact with the collars will cause the latter to rotate slowly. As the pipe 15 rotates the operator will observe a gap occurring intermittently between the collars and the rollers 10B and 10C if the pipe is bowed. As explained above, if such a bowed pipe were to be rotated at high speed without straightening, the vibration would be excessive and an uneven lining thickness would result. To correct the non-straightness, the hydraulic pressure to the jacks 30 is increased, thus causing the movable rollers 13 and 12 to bear against the respective collar 35 and straighten the axis of the pipe 15. The pipe 15 is then spun at the required speed to distribute the lining for a predetermined time until the polyurethane is cured, the pressure exerted by the rollers 12 and 13 being maintained throughout this spinning time. To effect curing of the polyurethane lining in a suitable time (approximately 30 minutes) hot air can be blown continuously through the inside of the pipe. This avoids the necessity for carrying out the straightening and spinning operation in an oven.

When the polyurethane has set the spinning is stopped, the hydraulic pressure is switched off and the collars opened. The line pipe will, of course, then return to its relaxed, bowed condition again but will have a lining of approximately constant thickness and of constant internal diameter throughout its length.

In one specific test construction for straightening and spinning steel pipes 20 feet long and up to 10 inches outside diameter and $\frac{1}{4}$ inch wall thickness, all the rollers 10 to 13 were 24 inches long, the fixed-position rollers 10 and 11 were of $12\frac{3}{4}$ inches diameter and the movable rollers 12 and 13 were of 7 inches diameter. The strongback had a stiffness of greater than 15 times that of the pipe so that any deflection in the strongback would be insignificant. For an eccentricity of approximately $\frac{1}{4}$ inch at the mid point before straightening (i.e., an eccentricity to length ratio of approximately 1:1000), it is believed that with this construction the eccentricity in the pipe can be reduced whilst spinning to approximately 1/10th of that in its relaxed condition (i.e., an eccentricity to length ratio of 1:10000), which would reduce the amount of additional lining material required to 20% above that required for an exactly straight pipe, whereas, at least 100% additional material would be required if such straightening was not applied. In practice a reduction of the eccentricity to 1:6000 is thought to be acceptable for most spinning operations envisaged.

In practice it cannot be assumed that the non-straightness of the pipe in the relaxed condition will always correspond to an axial bow of uniform radius of curvature. However, it is believed that apparatus such as that described will be able to cope with the majority of non-straight configurations met in practice up to an initial eccentricity/length ratio of 1:600.

It will be appreciated that various alternative arrangements of the strongback and rollers are possible. For example the strongback could be mounted on a base in a position turned through 90° from that shown in FIG. 2 so that the axes of the fixed-position rollers would lie in a common vertical plane with the movable pressure rollers being arranged above each other. With this arrangement it may be possible to arrange a further set of rollers on the other side of the same strongback to form a twin arrangement for spinning two pipes simultaneously.

According to a further feature the collar segments 36, 37 and 38 may have on their inner faces a resilient lining material 39 (see FIG. 5), for example rubber or polyurethane, to ensure a close fit between the inside of the collar and the outside of the pipe and to enhance the distribution of the applied forces. Such a resilient lining would also accomodate any ovality in the pipe, this being significant advantage because without using collars ovality causes vibrations and fluctuations in the positions of the movable rollers 12 and 13. Since the outside of the collars are machined precisely circular no such vibrations should occur when using collars. The resilient lining is also advantageous in accommodating the weld of a spirally welded pipe, as an alternative to providing the groove 45.

A further advantage of using collars is that the necessity of adjusting the positions of the rollers 10 to 13 to accommodate different diameter pipes can be avoided. Instead, a range of different collars can be provided all having the same outside diameter but affording a range of different inside diameters to suit various pipe diameters.

Another advantage which may accrue is that the collars, being accurately circular at their inside diameter, should tend to reduce any slight ovality which may occur in practice in the pipe cross-sections.

Whilst as described, one collar is provided for each set of rollers, 10 to 13, it may alternatively be possible to provide collars of greater axial extent so that one collar spans two adjacent sets of rollers.

For balancing reasons the collars may have to be aligned in their rotary positions along the pipe and it may perhaps be desirable to have tie bars extending in the axial direction between the collars. Clearly the collars should be approximately aligned so that for positioning the pipe in the collars and for its removal, the segments 36 and 37 all open to allow the pipe to be inserted or removed in an approximately vertical direction.

It will be appreciated that the actual arrangement of the rollers shown in FIG. 1 could be modified considerably to achieve the same effect of straightening the pipe. Thus, it may for example be possible to provide two strongbacks each carrying two relatively fixed-position rollers, one strongback being displaceable towards or away from the other.

I claim:

1. A method of temporarily straightening and spinning a non-straight pipe comprising providing a plurality of removable circular collars axially spaced along the pipe, which collars circumferentially closely surround the pipe and have a higher yield strength in the circumferential direction than that of the pipe wall, each collar being formed of three segments of approximately equal arcuate length and two of the segments being hingedly connected to respective opposite ends of the third segment so as to allow the segments to be pivoted relative to each other to open the collar for positioning the collar around the pipe, applying forces to the collars by means of roller elements in directions so as to straighten the pipe and to hold it substantially straight during rotation, and rotating the collars and the pipe.

2. A method as claimed in claim 1, wherein each segment consists of a plurality of segmental elements arranged axially side-by-side and secured to each other.

3. A method as claimed in claim 2, wherein the segmental elements are relatively staggered in the circumferential direction, the ends of axially alternate elements of one segment, in the closed position of the collar, lying between the ends of alternate elements of an adjacent segment.

4. A method as claimed in claim 1, wherein each collar has an axial length equal to at least half the outside diameter of the pipe.

5. A method as claimed in claim 4, wherein each roller has an axial length at least the same as the axial length of each collar.

6. A method as claimed in claim 1, wherein each collar is provided on its inner circumference with a lining of resilient material.

7. A method as claimed in claim 1, wherein each collar is provided on its inner circumference with a groove for accommodating the weld rib of a spirally welded pipe.

8. A method as claimed in claim 1, wherein the roller elements for applying forces to the collars comprise at least three sets of rollers, the axes of all the rollers being parallel and each set comprising four rollers arranged for bearing approximately equally spaced circumferential positions against a collar, the sets of rollers being spaced from each other in the axial direction, two rollers of each set being rotatably mounted on bearings fixed to a rigid frame and the other two rollers of each set being rotatably mounted and reciprocably movable in directions perpendicular to the axis of that roller and generally towards or away from the axis of the pipe, hydraulic driving means being provided for moving each movable roller of each set and means for drivingly rotating one or more of the fixed position rollers.

9. A method as claimed in claim 8, wherein one collar is provided for each set of rollers.

10. Pipe straightening and spinning apparatus comprising at least three sets of rollers, the axes of all the rollers being parallel and each set comprising four rollers arranged for acting at approximately equally spaced circumferential positions relative to a pipe located between them, the sets of rollers being spaced from each other in the axial direction so as to act at predetermined positions along the pipe length, two rollers of each set being rotatably mounted in bearings fixed to a rigid frame and the other two rollers of each set being rotatably mounted and reciprocably movable in directions perpendicular to the axes of the said other two rollers and generally towards or away from the axis of a pipe when located between the rollers, there being provided a plurality of collars, one for each set of rollers, to be positioned around a pipe at axial spacings along the pipe corresponding to the axial positions of the roller sets and which collars are adapted to closely surround the pipe and to have a higher yield strength in the circumferential direction than that of the pipe wall, each collar being formed of three segments of approximately equal arcuate length and two of the segments being hingedly connected to respective opposite ends of the third segment so as to allow the segments to be pivoted relative to each other to open the collar for positioning the collar around the pipe, hydraulic driving means for moving each movable roller of each set into contact with the respective collars to hold the collars in a closed condition around the pipe by roller contact and for applying pressure against the respective collars thereby to hold the pipe temporarily straight, and means for drivingly rotating one or more of the fixed-position rollers for spinning the pipe.

11. Apparatus as claimed in claim 10, wherein each segment consists of a plurality of segmental elements arranged axially side-by-side and secured to each other.

12. Apparatus as claimed in claim 11, wherein the segmental elements are relatively staggered in the circumferential direction, the ends of axially alternate elements of one segment, in the closed position of the collar, lying between the ends of alternate elements of an adjacent segment.

13. Apparatus as claimed in claim 10, wherein each collar is provided on its inner circumference with a lining of resilient material.

14. Apparatus as claimed in claim 10, wherein each collar is provided on its inner circumference with a groove for accommodating the weld rib of a spirally welded pipe.

15. Apparatus as claimed in claim 10, wherein four sets of rollers are provided, two of the sets being axially located so as to bear against collars located respectively adjacent each end of the pipe and the other two sets being axially located so as to bear against collars located at the mid portion of the pipe.

16. Apparatus as claimed in claim 10, wherein the diameter of each movable roller is equal to half the diameter of each fixed position roller, and wherein each movable roller is carried by the ends of two rocking levers, one lever being situated at each end of the roller, each lever being pivotally mounted about a point intermediate its ends, the hydraulic driving means being connected to act upon the other end of each lever.

17. Apparatus as claimed in claim 16, wherein the bearings of all the fixed-position rollers are rigidly connected to a rigid frame in the form of a strongback the stiffness of which is many times greater than the stiffness of the pipe to be straightened.

18. Apparatus as claimed in claim 17, wherein the rocking levers are pivotably connected to the strongback.

* * * * *